US007124926B1

(12) United States Patent
Tsai

(10) Patent No.: US 7,124,926 B1
(45) Date of Patent: Oct. 24, 2006

(54) STAPLER CAPABLE OF CUTTING STAPLE LEGS

(75) Inventor: Eric Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 0 days.

(21) Appl. No.: 11/160,123

(22) Filed: Jun. 9, 2005

(51) Int. Cl.
*B25C 5/02* (2006.01)

(52) U.S. Cl. ..... 227/155; 227/156; 227/79

(58) Field of Classification Search ..... 227/79, 227/155–156, 132, 134, 120
See application file for complete search history.

(56) References Cited

U.S. PATENT DOCUMENTS

| | | | | |
|---|---|---|---|---|
| 1,962,874 | A | 6/1934 | Polzer | |
| 2,083,227 | A | 6/1937 | Drypolcher | 227/76 |
| 3,034,382 | A | 5/1962 | Herbert | 29/566 |
| 4,199,095 | A | 4/1980 | Yamanoi | 227/125 |
| 4,378,085 | A | 3/1983 | McVeigh | 227/79 |
| 4,449,661 | A | 5/1984 | Spehrley, Jr. | 227/155 |
| 4,593,847 | A | 6/1986 | Hagemann | 227/155 |
| 4,664,305 | A | 5/1987 | Blake et al. | 227/19 |
| 4,844,319 | A | 7/1989 | Kurosawa | 227/79 |
| 5,029,745 | A | 7/1991 | Akizawa et al. | 227/155 |
| 5,413,266 | A | 5/1995 | Jairam | 227/129 |
| 5,516,025 | A | 5/1996 | Eriksson | 227/155 |
| 5,586,710 | A | 12/1996 | Golicz | 227/155 |
| 5,639,007 | A | 6/1997 | Nakamura | 227/109 |
| 5,645,567 | A | 7/1997 | Crainich | 606/219 |
| 5,758,813 | A | 6/1998 | Kikuchi et al. | 227/155 |
| 5,791,543 | A | 8/1998 | Udagawa et al. | 227/4 |
| 6,036,074 | A | 3/2000 | Manabe | 227/155 |
| 6,056,183 | A * | 5/2000 | Tanabe | 227/155 |
| 6,250,531 | B1 | 6/2001 | Yagi | 227/79 |
| 6,698,640 | B1 | 3/2004 | Hakozaki et al. | 227/4 |
| 6,776,321 | B1 | 8/2004 | Jairam et al. | 227/134 |
| 6,820,790 | B1 | 11/2004 | Ura | 227/131 |
| 6,935,547 | B1 | 8/2005 | Mochizuki | 227/131 |
| 6,942,136 | B1 * | 9/2005 | Tsai | 227/155 |
| 6,981,626 | B1 | 1/2006 | Tsai | 227/79 |
| 6,981,627 | B1 | 1/2006 | Tsai | 227/155 |
| 7,021,515 | B1 | 4/2006 | Elonsson et al. | 227/134 |
| 2003/0111506 | A1 | 6/2003 | Kanai et al. | 227/131 |
| 2006/0118593 | A1 | 6/2006 | Tsai | 227/76 |

FOREIGN PATENT DOCUMENTS

DE 44 34 513 C1 8/1995

OTHER PUBLICATIONS

PCT Patent Publication No. WO 03/057417 A1, Jul. 17, 2003, 24 pages.

* cited by examiner

*Primary Examiner*—John Sipos
*Assistant Examiner*—Michelle López
(74) *Attorney, Agent, or Firm*—Alan D. Kamrath; Nikolai & Mersereau, P.A.

(57) ABSTRACT

A stapler includes a base, a cover coupled to the base, a driver for driving a leading staple from a supply of staples into a workpiece, a handle constructed and arranged to actuate the driver and move the cover towards the base, and a cutting assembly. The cutting assembly includes a pair of benders constructed and arranged to engage and bend the legs of the leading staple, a stationary cutter, and a pair of movable cutters that interact with the stationary cutter to cut an excess length of each of the legs of the staple. Movement of the cover towards the base causes the movable cutters to move towards the stationary cutter.

20 Claims, 7 Drawing Sheets

STAPLER CAPABLE OF CUTTING STAPLE LEGS

BACKGROUND OF INVENTION

1. Field of Invention

The present invention relates to a stapler and, more particularly, to a stapler capable of cutting staple legs.

2. Background of Invention

WO 03/057417 A1 discloses a STAPLER WITH BENDING ARMS WHICH CUT THE STAPLER LEGS AGAINST A PAD. The stapler includes two bending arms 40 and 41 and a cutting pad 49. However the stapler requires precise location of cutting edges and thus requires precise fabrication and assembly and inevitably incurs a high cost. Moreover, while the bending arms 40 and 41 and the cutting pad 49 are initially precisely fabricated and assembled, the gaps between them will eventually become too large for adequate operation as they wear out after time of service. In that case, a user will have to use a lot of energy and spend a long time to staple a stack of paper with a staple. In addition, the pivoted bending arms perform both a bending and cutting function. Integrating the bending and cutting functionality into the pivoted bending arms does not achieve both functions in an effective manner.

The present invention is therefore intended to obviate or at least alleviate the problems encountered in the prior art.

SUMMARY OF INVENTION

According to embodiments of the present invention, a stapler includes a base, a cover coupled to the base, a driver for driving a leading staple from a supply of staples into a workpiece, a handle constructed and arranged to actuate the driver and move the cover towards the base, and a cutting assembly. The cutting assembly includes a pair of benders constructed and arranged to engage and bend the legs of the leading staple, a stationary cutter, and a pair of movable cutters that interact with the stationary cutter to cut an excess length of each of the legs of the staple. Movement of the cover towards the base causes the movable cutters to move towards the stationary cutter.

According to embodiments of the invention, a stapler includes a base, a cover connected to the base, a driver for driving a leading staple from a supply of staples into a workpiece, and a handle operatively connected to the base. The handle is constructed and arranged to actuate the driver and move the cover towards the base. The stapler also includes a pair of benders constructed and arranged to engage each of the legs of the leading staple and move the legs into respective cutting paths, and a cutter having a stationary portion, and a pair of movable portions constructed and arranged to interact with the stationary portion to cut the legs after they are moved into the respective cutting paths. The movable portions are movable independently from the benders.

The stapler of the present invention may be manufactured at a lower cost because it does not require high precision in assembly.

Other advantages and novel features of the invention will become more apparent from the following detailed description in conjunction with the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
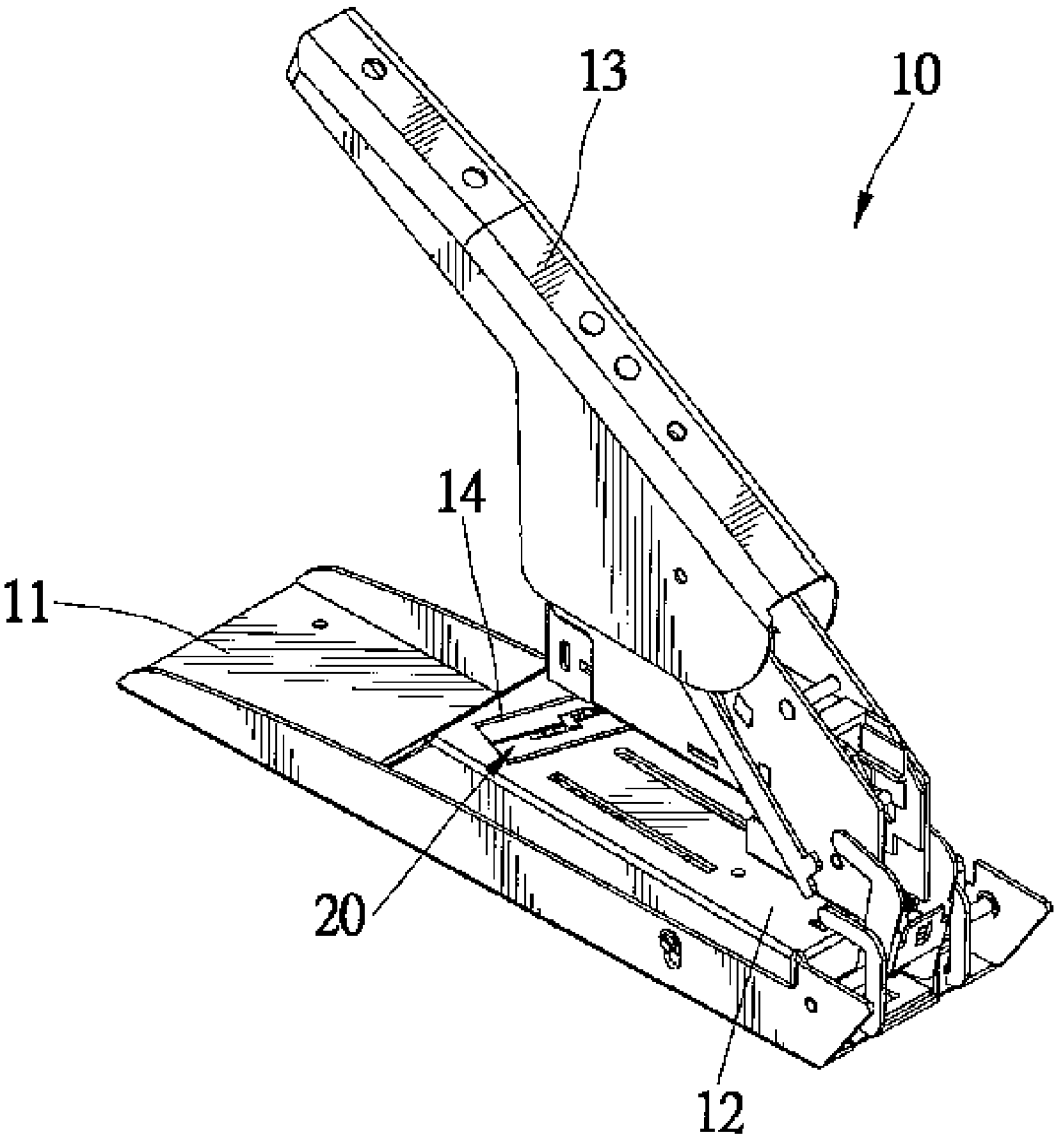
FIG. 1 is a perspective view of a stapler with a cutting assembly according to the preferred embodiment of the present invention.
Figure 2:
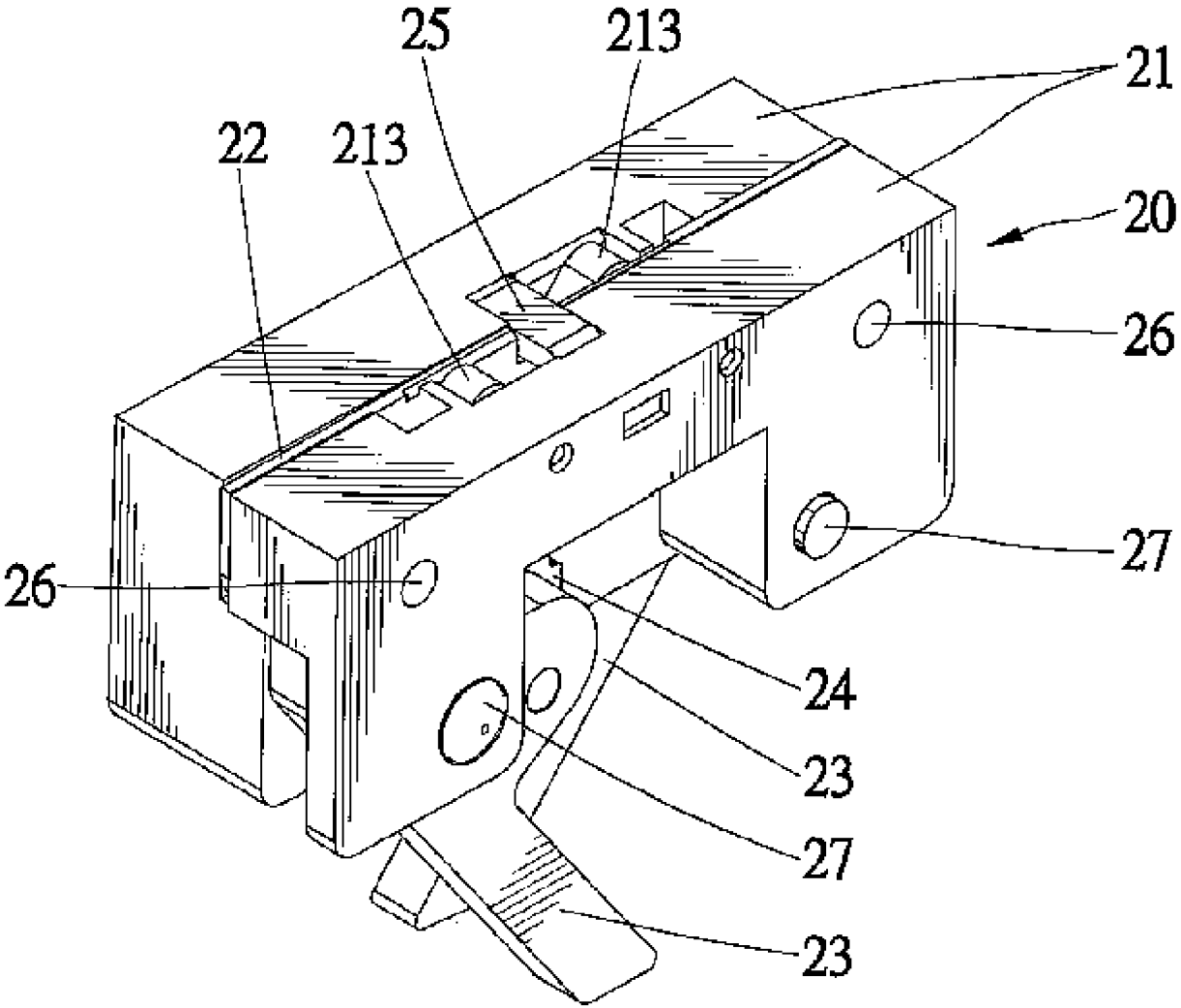
FIG. 2 is a perspective view of the cutting assembly shown in FIG. 1.

Referring to FIGS. 1 and 2, a stapler 10 is equipped with a cutting assembly 20 according to the preferred embodiment of the present invention. The stapler 10 includes a base 11, a cover 12 put on the base 11, a cartridge (not numbered) for storing staples 30 (FIGS. 4 through 7), a handle 13 for feeding the staples 30 to the cutting assembly 20 one after another, and a connecting device (not numbered) for connecting the base 11, the cover 12 and the handle 13 to one another. The cover 12 defines an opening 14 for receiving the cutting assembly 20. The above-mentioned elements are substantially conventional and will not be described in detail except the cutting assembly 20.

Figure 3:
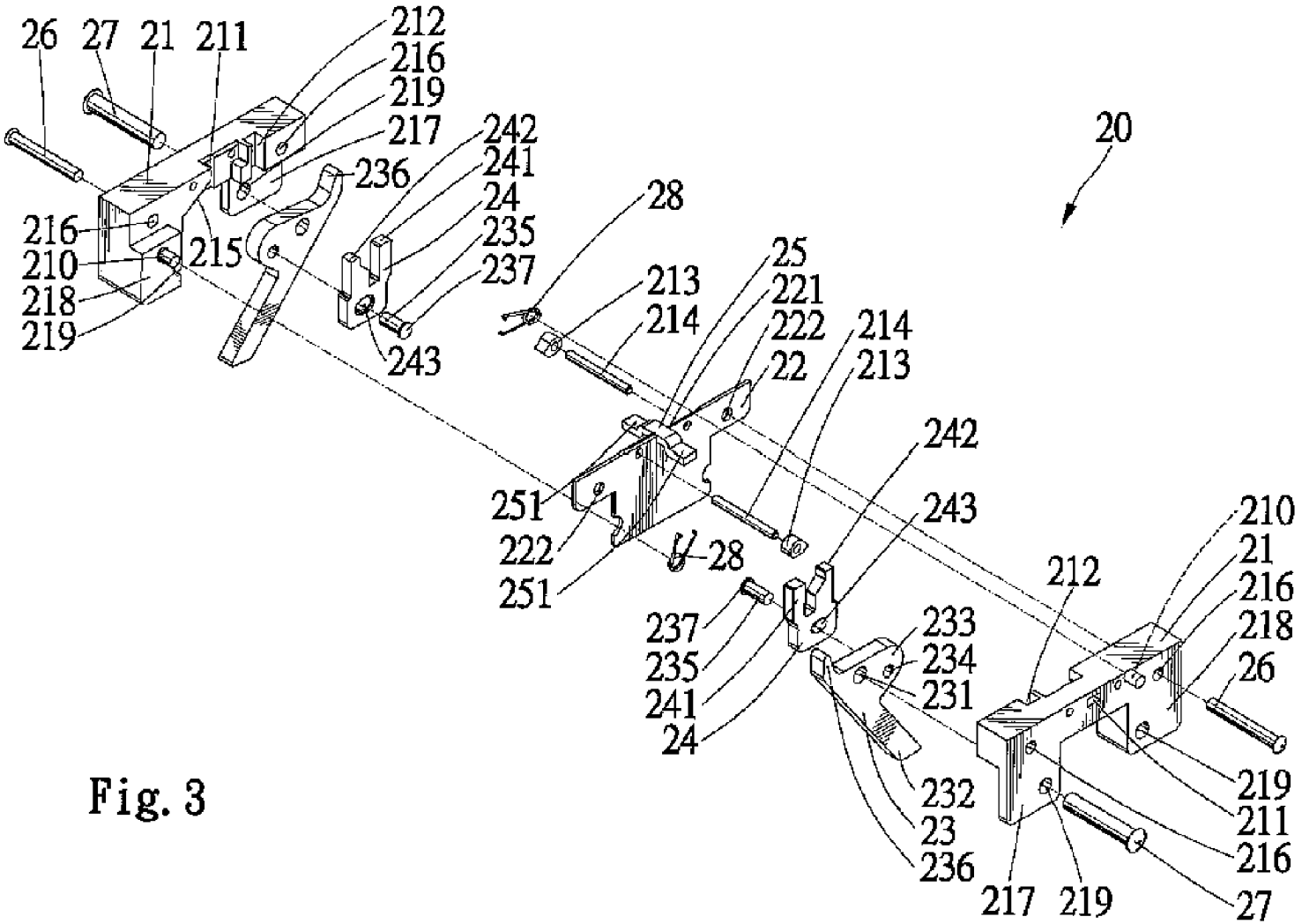
FIG. 3 is an exploded view of the cutting assembly shown in FIG. 2.
Figure 4:
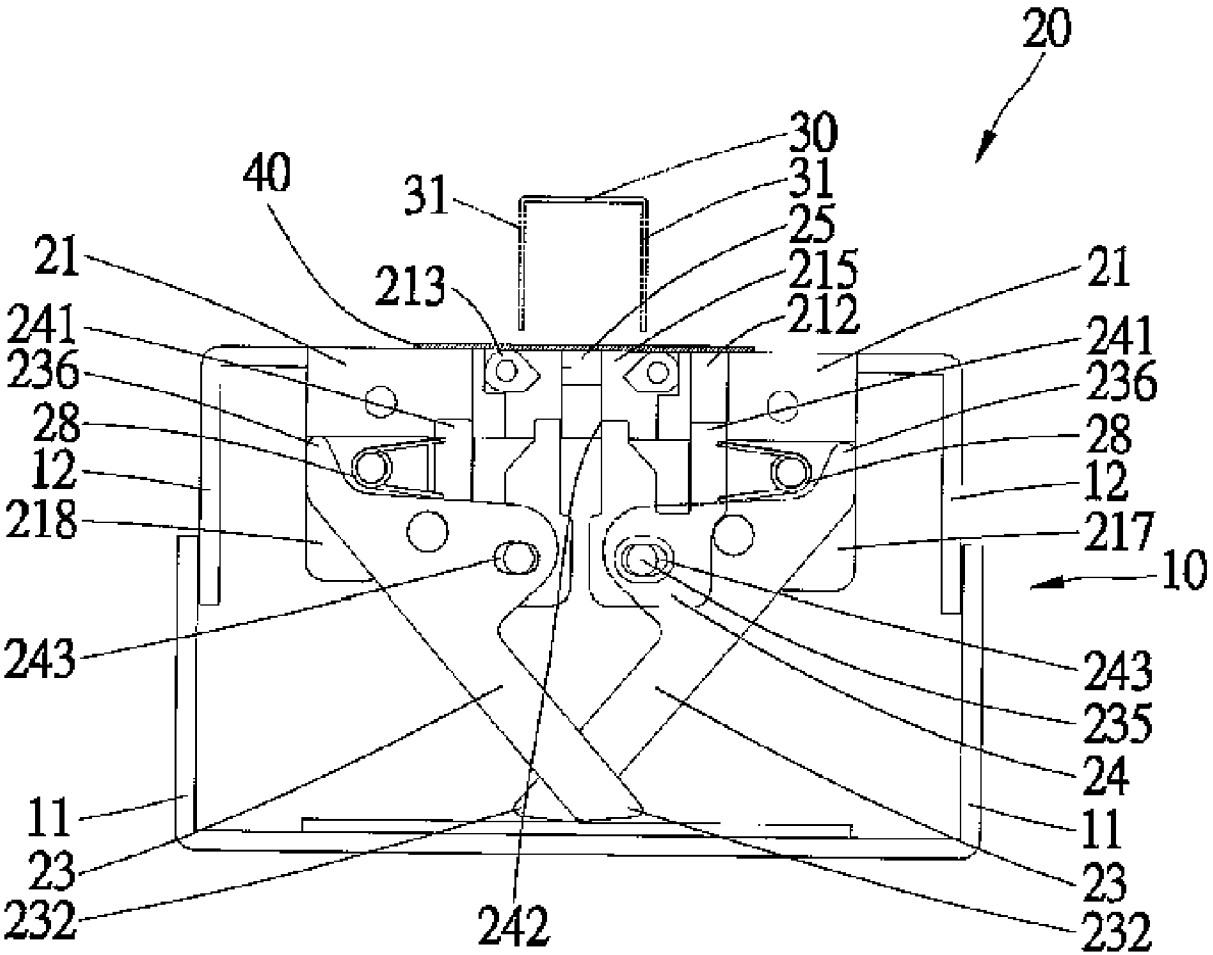
FIGS. 4 through 7 are cross-sectional views of the cutting assembly shown in FIG. 3 at different steps in operation.
Figure 5:
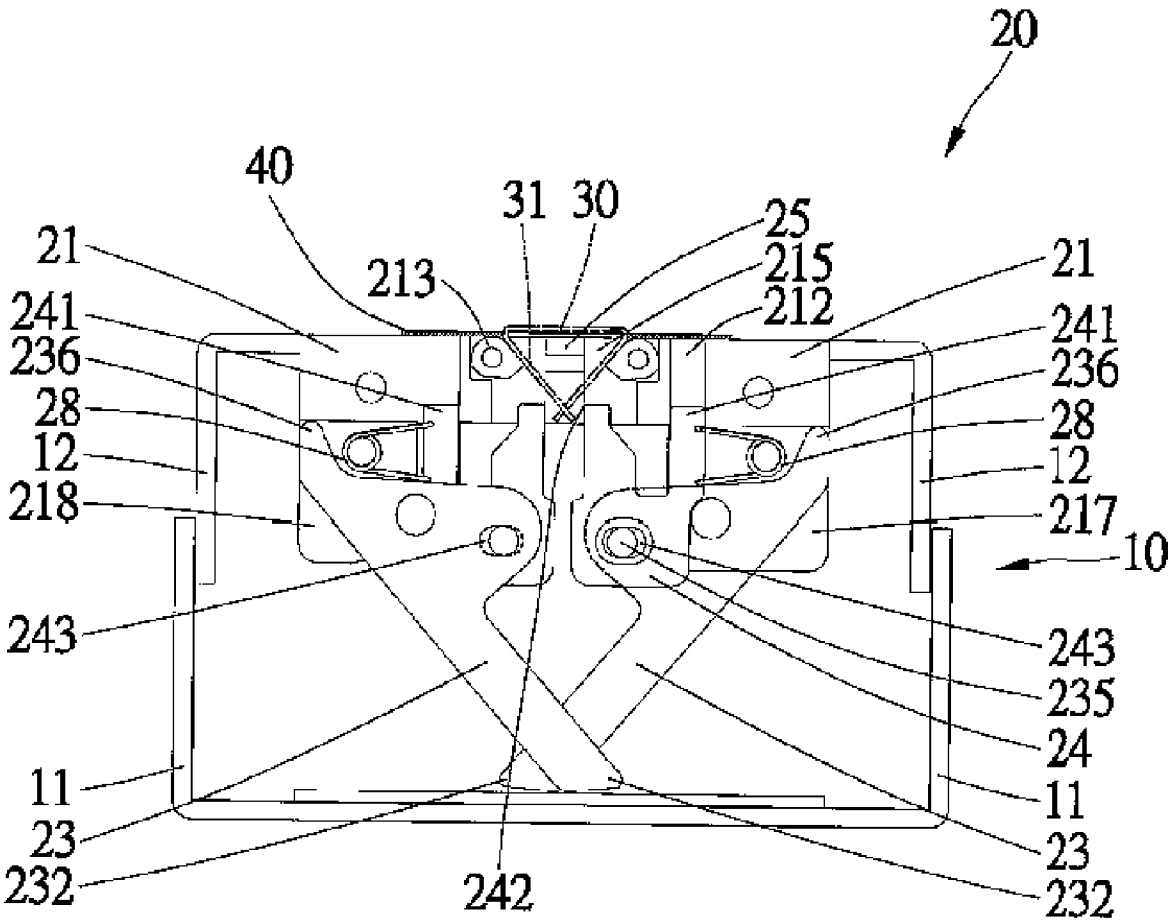

Referring to FIGS. 2 through 4, the cutting assembly 20 includes two shells 21, a partition 22, two benders 213, two levers 23, two linearly movable cutters 24, and a stationary cutter 25. The partition 22 is sandwiched between the shells 21 in order to define two spaces (not numbered). Each bender 213 is put in one of the spaces. Each lever 23 is put pivotally in one of the spaces. Each movable cutter 24 is put movably in one of the spaces. The stationary cutter 25 is put on the shells 21 across the partition 22. As the handle 13 is pivoted towards the base 11, the legs 31 of a staple 30 are fed into the spaces, and bent by the benders 213. The benders 213 bend the legs 31 of the staple 30 such that the legs 31 are positioned in a cutting path of the movable cutters 24, as shown in FIG. 5. The levers 23 are pivoted against the base 11. The movable cutters 24 are moved towards the stationary cutter 25 by the levers 23. The legs 31 of the staple 30 are cut by the movable cutters 24 and the stationary cutter 25. The movable cutters 24 engage the benders 213 and cause the benders 213 to rotate towards the legs 31 of the staple 30, thereby clinching the legs 31 of the staple 30 into a bent position, along the under side of the workpiece.

Each shell 21 defines a recess 211 for receiving an end 251 of the stationary cutter 25. Each shell 21 defines a groove 212 and a space 215. Each shell 21 includes a thin portion 217 in which an aperture 219 is defined and a thick portion 218 in which an aperture 219 is defined and on which a stem 210 is formed. The thin portion 217 of one of the shells 21 is put against the thick portion 218 of the other shell 21.

The partition 22 defines a cutout 221 for receiving a middle portion of the stationary cutter 25.

Each pusher 213 is secured to one of the shells 21 by a pin 214.

Two pins 26 are fit in two apertures 216 defined in each shell 21 and two apertures 222 defined in the partition 22. Thus, the shells 21 and the partition 22 are bonded with one another.

Each lever 23 defines an aperture 231. A pin 27 is inserted in the aperture 231 of each of the levers 23 through one of the apertures 219 of each of the shells 21. Thus, the levers 23 are pivotal, and the bonding of the shells 21 with each other is enhanced. Each lever 23 includes a lower end 232, an upper end 236, a toggle 233 between the upper and lower ends, and an aperture 234 in the toggle 233.

A spring 28 is put on the stem 210 of each of the shells 21 against one of the levers 23. Thus, the levers 23 will be moved back to their original position by the springs 28 when the handle 13 is not pivoted towards the base 11.

Each movable cutter 24 includes a slide 241 put fittingly and movably in the groove 212 of one of the shells 21 and a blade 242 put movably in the space 215 of one of the shells 21. Each movable cutter 24 defines a slot 243 through which a pin 235 is fit into the aperture 243 of one of the levers 23. Thus, each movable cutter 24 is movably connected to one of the levers 23. The slot 243 is like a countersink hole so that the head 237 of the pin 235 is flush with one of the movable cutters 24.

Referring to FIG. 4, the upper end 236 of each lever 23 is put against a portion of one of the shells 21.

Referring to FIG. 5, the legs 31 of a staple 30 are punched into the cutting assembly 20 through a stack of paper 40. The legs 31 are bent by the benders 213. The bent legs 31 are moved into the spaces 215. The levers 23 are moved towards the base 11 together with the cover 12, and the lower ends 232 thereof against the base 11. Thus, the levers 23 are pivoted. The pins 235 on the toggles 233 of the levers 23 push the movable cutters 24 towards the stationary cutter 25. The slots 243 in the toggles 233 of the levers 23 allow the levers 23 to move the movable cutters 24 vertically without moving the movable cutters 24 horizontally.

Figure 6:
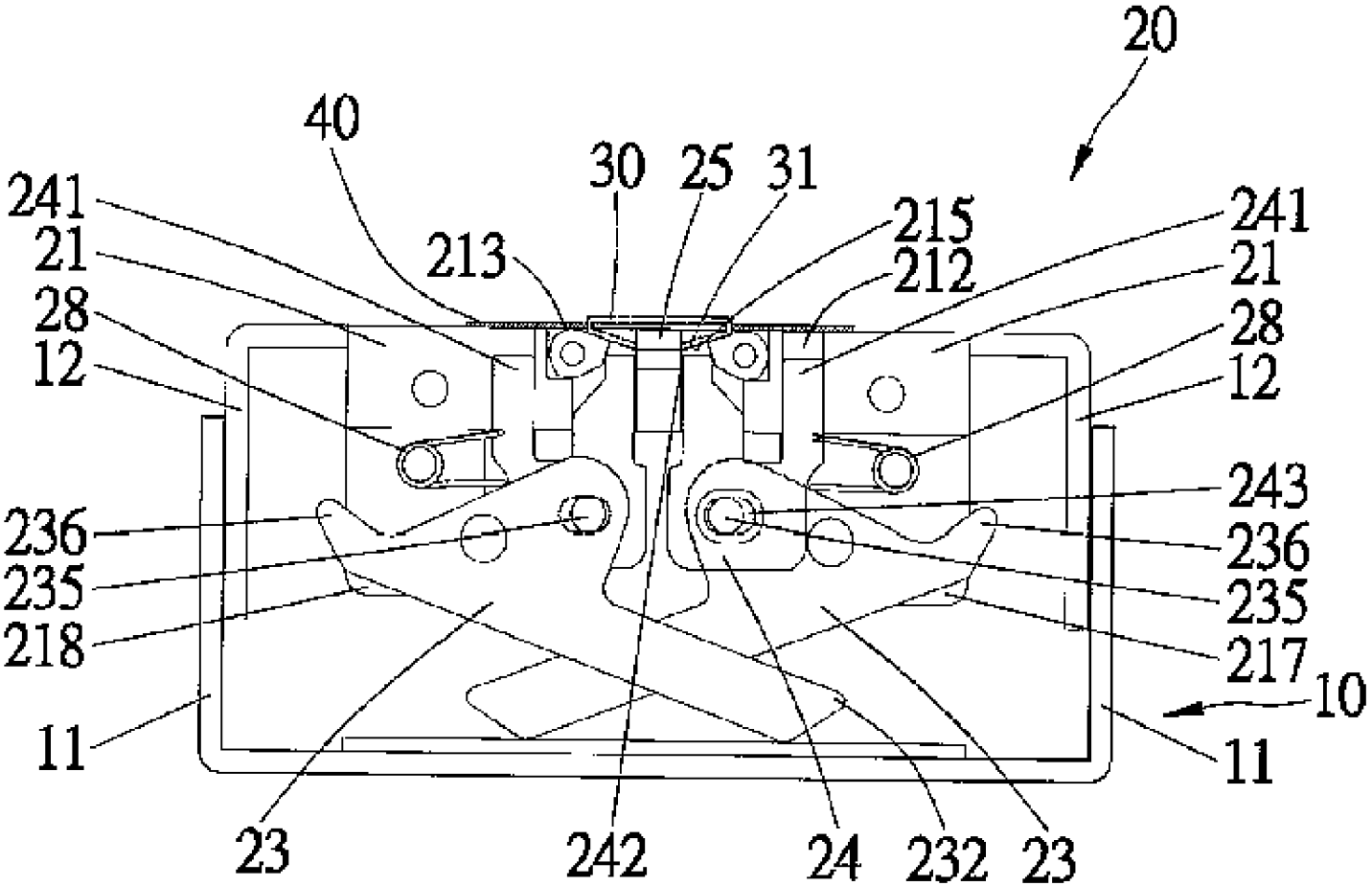

Referring to FIG. 6, the legs 31 are cut by the blades 242 in cooperation with the stationary cutter 25.

Figure 7:
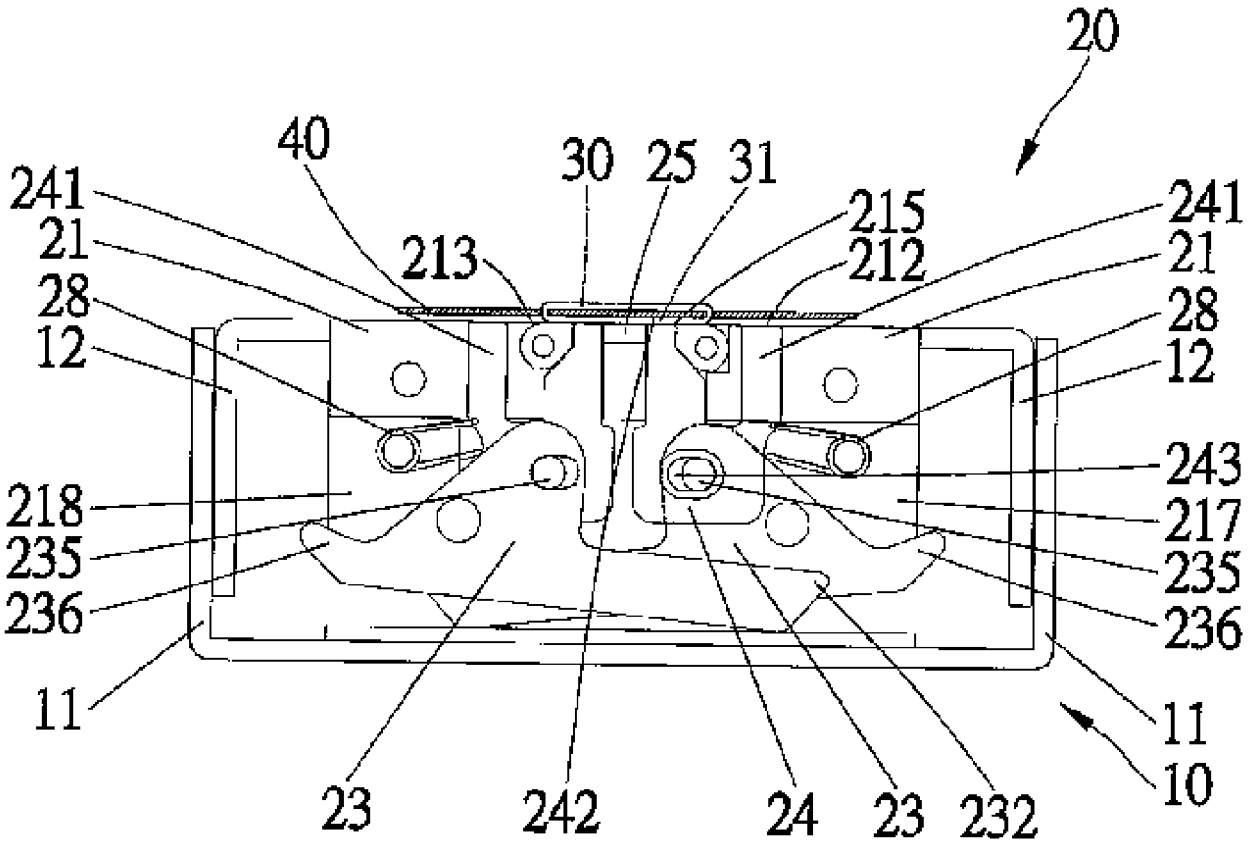

Referring to FIG. 7, the legs 31 are bent by the benders 213 and finally pressed against the stack of paper 40.

One aspect of the stapler of the present invention is its low cost because it does not require high precision in assembly due to the movable cutters 24 that are moved linearly towards the stationary cutter 25 instead of pivoted. In addition, the present invention effectively separates the bending action from the cutting action, so that these functions are performed by different parts, to achieve both functionalities in a more effective manner.

The present invention has been described through the detailed description of the preferred embodiment thereof. Those skilled in the art can derive variations from the preferred embodiment without departing from the scope of the present invention. Therefore, the preferred embodiment shall not limit the scope of the present invention defined in the claims.

What is claimed is:

1. A stapler comprising:

a base;

a cover coupled to the base;

a driver for driving a leading staple from a supply of staples into a workpiece, with each staple having first and second legs;

a handle constructed and arranged to actuate the driver and move the cover towards the base; and a cutting assembly comprising:

a pair of benders constructed and arranged to engage and bend the first and second legs of the leading staple;

a stationary cutter; and first and second independently movable cutters that independently interact with the stationary cutter to cut an excess length of each of the first and second legs of the staple, wherein movement of the cover towards the base causes the first and second independently movable cutters to move towards the stationary cutter.

2. The stapler according to claim 1, wherein the interaction of the first and second independently movable cutters and the stationary cutter shears the first and second legs of the staple.

3. The stapler according to claim 2, wherein each of the movable cutters comprises a blade for cooperation with an edge of the stationary cutter for shearing one of the first and second legs of the staple.

4. The stapler according to claim 1, wherein the cutting assembly further comprises a pair of levers, each lever being connected to one of the first and second movable cutters and being in contact with the base.

5. The stapler according to claim 4, wherein the cutting assembly further includes a housing that substantially encloses the benders, the cutters, and the levers.

6. The stapler according to claim 5, wherein the housing comprises two shells attached to each other.

7. The stapler according to claim 6, wherein each of the shells defines a recess for receiving an end of the stationary cutter.

8. The stapler according to claim 4, wherein each of the shells defines a space for receiving one of the first and second legs of the staple.

9. A stapler comprising:

a base;

a cover coupled to the base;

a driver for driving a leading staple from a supply of staples into a workpiece, with each staple having first and second legs;

a handle constructed and arranged to actuate the driver and move the cover towards the base; and a cutting assembly comprising:

a pair of benders constructed and arranged to engage and bend the first and second legs of the leading staple;

a stationary cutter;

a pair of movable cutters that interact with the stationary cutter to cut an excess length of each of the first and second lees of the staples wherein movement of the cover towards the base causes the movable cutters to move towards the stationary cutter; and a housing substantially enclosing the benders, the stationary cutter and the pair of movable cutters, wherein the housing comprises two shells attached to each other, wherein each of the shells defines a groove, and wherein each of the movable cutters comprises a slide for sliding in one of the grooves.

10. The stapler according to claim 9, wherein the cutting assembly further comprises a pair of levers, each lever being connected to one of the pair of movable cutters and being in contact with the bases with the housing substantially enclosing the pair of levers, wherein each of the movable cutters defines a slot, and each of the levers defines an opening, and wherein a pin is located in the slot and the opening to connect one of the movable cutters to one of the levers.

11. The stapler according to claim 10, wherein each of the levers comprises a lower end for sliding on the base, an upper end for abutting one of the shells, and a toggle in which the opening is defined.

12. The stapler according to claim 11, wherein the cutting assembly further comprises a pair of springs for biasing the levers.

13. The stapler according to claim 6, wherein the housing further comprises a partition located between the movable cutters.

14. The stapler according to claim 13, wherein the partition defines a cutout for receiving a portion of the stationary cutter.

15. The stapler according to claim 9, wherein the movable cutters are moved towards the stationary cutter in a substantially rectilinear path.

16. A stapler comprising:

a base;

a cover coupled to the base;

a driver for driving a leading staple from a supply of staples into a workpiece, with each staple including first and second legs;

a handle operatively connected to the base, the handle being constructed and arranged to actuate the driver and move the cover towards the base; and a pair of benders constructed and arranged to engage each of the first and second legs of the leading staple and move the first and second legs into respective cutting paths; and a cutter having a stationary portion, and first and second, independently movable portions constructed and arranged to independently interact with the stationary portion to cut the first and second legs after first and second, independently movable portions are independently moved into respective cutting paths, with the first and second independently movable portions being movable independently from the benders.

17. The stapler according to claim 16, wherein the cutting paths are substantially linear toward the stationary portion.

18. The stapler according to claim 17, further comprising a pair of levers, each lever being associated with one of the first and second, independent movable portions, and wherein the levers are constructed and arranged to rotate as the cover is moved towards the base and move the first and second, independent movable portions of the cutter along the respective cutting paths.

19. The stapler according to claim 18, wherein the movable portions of the cutter engage the benders while moving along the cutting paths and cause the benders to rotate and clinch the first and second legs against the workpiece.

20. The stapler according to claim 19, wherein the cutting paths are substantially parallel to the first and second legs of the staple when the first and second legs first contact the workpiece.

* * * * *